US005882077A

United States Patent [19]

Gebhard

[11] Patent Number: 5,882,077

[45] Date of Patent: Mar. 16, 1999

[54] HEIGHT ADJUSTMENT OF BACK RESTS

[75] Inventor: Reinhard Gebhard, Burgthann, Germany

[73] Assignee: SIFA Sitzfabrik GmbH, Germany

[21] Appl. No.: 913,114

[22] PCT Filed: Dec. 7, 1996

[86] PCT No.: PCT/DE96/02350

§ 371 Date: Nov. 25, 1997

§ 102(e) Date: Nov. 25, 1997

[87] PCT Pub. No.: WO97/24958

PCT Pub. Date: Jul. 17, 1997

[30] Foreign Application Priority Data

Jan. 10, 1996 [DE] Germany ..... 296 00 332 U

[51] Int. Cl.[6] ..... A47C 7/40

[52] U.S. Cl. ..... 297/353; 248/412

[58] Field of Search ..... 297/353, 411.36; 248/295.11, 316.2, 316.3, 411, 412

[56] References Cited

U.S. PATENT DOCUMENTS

| | | | |
|---|---|---|---|
| 1,075,323 | 10/1913 | Benjamins | 248/412 |
| 1,101,552 | 6/1914 | Hume | 248/412 |
| 3,467,352 | 9/1969 | Bohler | 248/412 X |

*Primary Examiner*—Peter R. Brown
*Attorney, Agent, or Firm*—Morrison Law Firm

[57] ABSTRACT

The invention concerns the height-adjustment of the back-rests of chairs, especially office chairs, consisting of a housing (1) in which a flat back-rest carrier (2) is held by a ball-stop clamp (3, 4), the back-rest carrier (2) being provided with a series of indentations or holes (3) arranged behind one another in an axial direction for the stop balls (4) which are held in the indentations or holes (3) by means of a spring-loaded clamping bevel (5'). The clamping bevel (5') can be brought out of contact by a push-button (8) guided sideways from outside the housing against the spring force, spring-loaded means (10, 11) being arranged in the housing (1) for the prevention of sideways play of the back-rest carrier (2).

8 Claims, 2 Drawing Sheets

FIG. 1
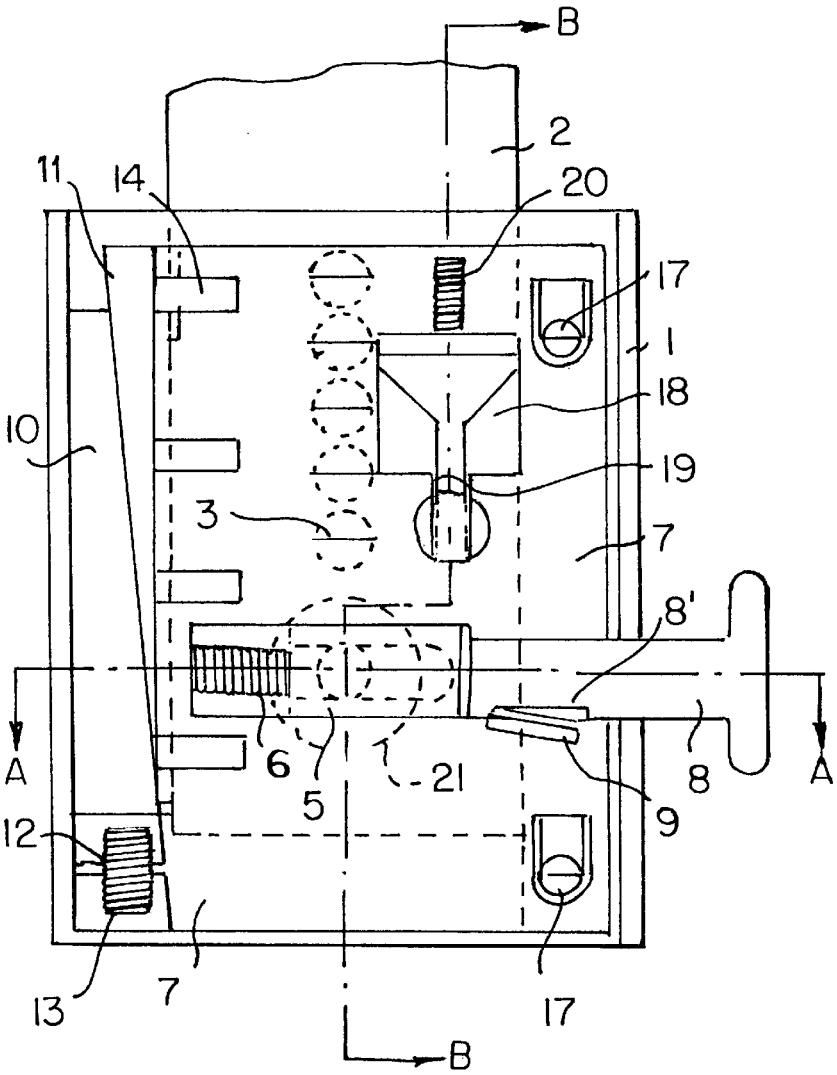
FIG. 3
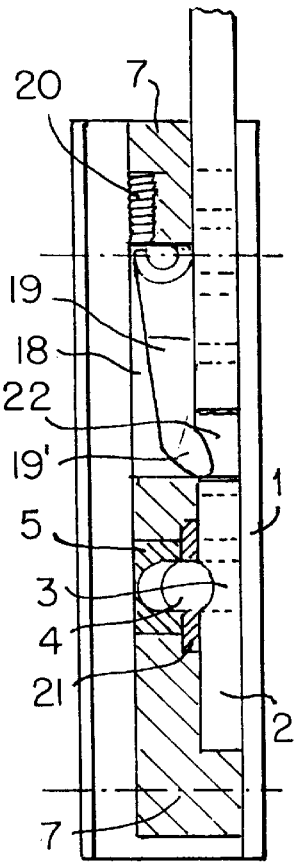
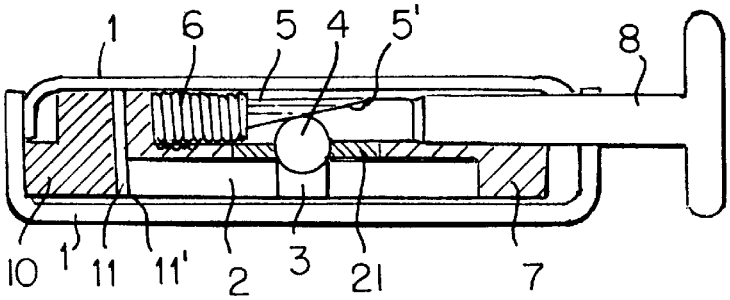
FIG. 2

FIG. 4b
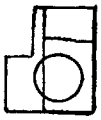
FIG. 4d
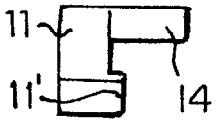
FIG. 4f
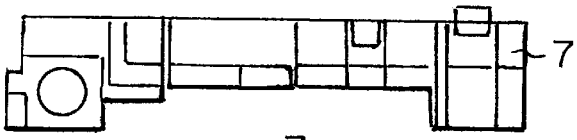
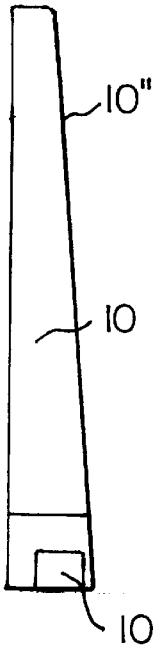
FIG. 4a
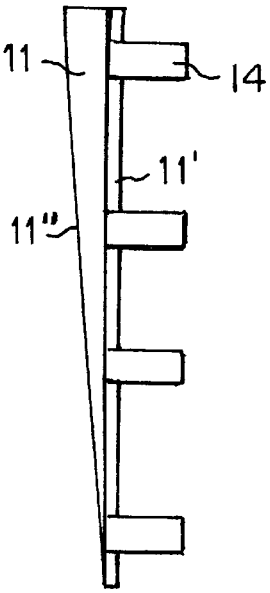
FIG. 4c
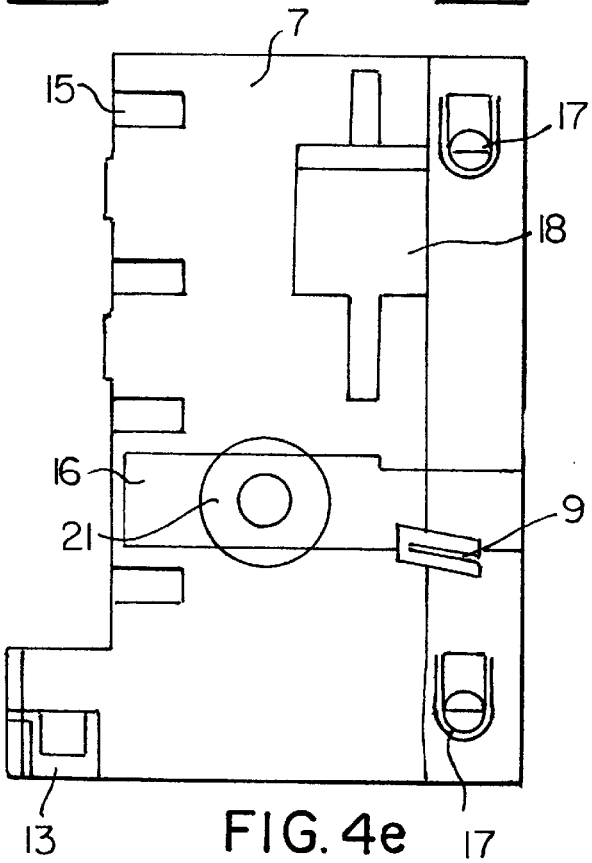
FIG. 4e
FIG. 5a
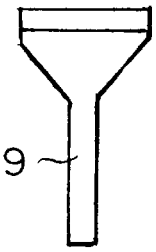
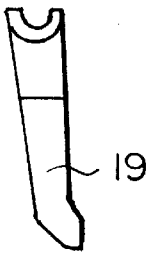
FIG. 5b
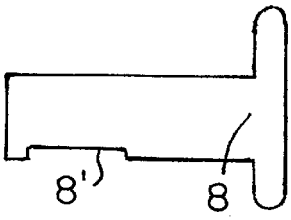
FIG. 6a
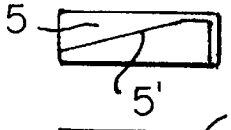
FIG. 6c
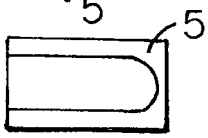
FIG. 6b

HEIGHT ADJUSTMENT OF BACK RESTS

DESCRIPTION

The invention relates to a height adjustment for back rests.

Such a height adjustment for back rests of chairs, in particular office chairs, consisting of a housing in which a flat back rest carrier is held by a detent ball clamping arrangement, whereby the back rest carrier is provided in axial direction with successively arranged indentations or openings for detent balls which are held in the indentations or openings by a spring-loaded clamping bevel, and whereby a push button that extends laterally from the housing can be used to move the clamping bevel against the elastic force to disengage it, is known, for example, from EP-A-O 264 555.

The objective of the present invention is to create a height adjustment of the type mentioned above which is easy and comfortable to operate and which functions reliably.

Further developments and advantageous embodiments of the invention are described hereinafter.

According to the invention, spring-loaded means are arranged in the housing to prevent lateral play of the back rest carrier. Thanks to this measure, the back rest cannot tilt and rock. According to a preferred embodiment of the invention, the means to prevent the lateral play of the back rest carrier consist of two wedges whose bevelled surfaces lie apart, whose parallel outside surfaces adjoin the housing wall on one side and on a side of the back rest carrier on the other side, and whereby the wedge adjoining the housing wall is spring-loaded on its wider end. The spring-loaded wedge presses its bevel against the bevel of the wedge that adjoins the back rest carrier, so that a force is applied laterally to the back rest carrier and brings it to adjoin the housing or a part connected to same. Thus, the back rest carrier can slide without play.

According to a preferred embodiment of the invention, inside the housing, a base plate is fastened in which the other side of the back rest carrier is guided and which supports the spring for the wedge adjoining the housing wall. The base plate contains guidance means, such as grooves, for guidance components such as journals, of the wedge adjoining the back rest carrier.

To prevent that the back rest is unintentionally pulled out of the housing, another indentation or opening is arranged, in addition to the row of indentations or openings, laterally at the bottom end of same, and above this indentation or opening a spring-loaded locking means is arranged for engaging in the further indentation or opening. Preferably, the locking means is a detent arm which locks when the back rest carrier is pulled upward and releases the back rest carrier again when it is pushed in. For example, this detent arm can be pivotably mounted in the base plate.

The invention is described below by way of example and with reference to the drawings, in which:

FIGS. 1 to 3 show three views of a height adjustment including a top view in FIG. 1 with the upper housing part cut away, in FIG. 2 a section along the line A—A, and in FIG. 3 a section along the line B—B of FIG. 1;

FIGS. 4*a* to 6*c* show separate components from FIG. 1.

The height adjustment according to FIGS. 1 to 6*c* consists of a flat housing 1, with a substantially rectangular cross section, in which a flat back rest carrier 2 is slidably guided and can be clamped. The housing can be extended at the bottom and connected to a seat carrier. It can also have different dimensions than those shown, and it can have a curved shape.

Along its center axis, back rest carrier 2 is provided with a number of holes 3 which define the insertion depth. In one of these holes 3 is a detent ball 4 which is pressed into the hole by a clamping bevel 5' of a shuttle 5. The pressure results from a spring 6 which is supported in a base plate 7 fastened in housing 1, for example by means of screws 17 or catches. Base plate 7 is provided with a groove 16 in which the shuttle 5 can slide and on which the side opposite spring 6 comes to a stop. On this side, shuttle 5 is adjoined by a push-button 8 with which it can be pushed back against the force of spring 6, upon which clamping bevel 5' releases the ball 4, and the back rest can be moved until the desired insertion depth is reached, and the push-button 8 is released again. Push-button 8 has a flat recess 8' in which a small spring 9 engages during installation, which means that push-button 8 can no longer be pulled out. This measure prevents the unintentional release of push-button 8 and provides an opportunity to insert different shapes of push-buttons in the same height adjustment without problem. Since the base plate 7 is preferably made of plastic, a metal washer 21 is inserted in the area where the detent ball 4 pushes against the clamping bevel 5', to ensure proper functioning at all times.

Base plate 7 extends from the side of the push-button 8 across a large portion of the base surface of housing 1; it has a running surface and a stop edge for back rest carrier 2. On the other side, back rest carrier 2 adjoins at a step 11' the straight side of a wedge 11 whose bevel 11" adjoins bevel 10" of a second wedge 10, which in turn adjoins the inside housing wall with its straight side. The second wedge 10 is spring-loaded at its wide end with a pressure spring 12 which is supported in a ledge 13 of the base plate. The spring 12 pushes wedge 10 upward as shown in FIG. 1, which via bevels 10" and 11" conducts a lateral force onto back rest carrier 2, which is thus guided without play. Base plate 7 is provided with grooves 15 which are open toward the first wedge 11 and slidably accommodate guide journal 14 (FIG. 4*c* and 4*e*). Thus, this wedge 11 is guided and cannot give way.

The height adjustment is provided with a pull-out lock which is shown in FIGS. 1 and 3 in staggered position. This pull-out lock has a hole 22 which actually must lie next to the last hole 3 for the detent ball or in FIG. 1 even below it. Arranged above this hole 22 in a recess 18 of base plate 7 is a pivotable detent arm 19 which is spring-loaded with a spring 20 supported in base plate 7 in such a way that its catch 19'—as shown in FIG. 3—is pressed into hole 22 as soon as the back rest is pulled out far enough. Then the back rest is blocked. Detent arm 19 does not prevent it from being pushed in, since it has a bevel in that direction.

I claim:

1. A back rest on a chair having a height adjustment mechanism thereon, comprising a housing in which a flat back rest carrier is held by a detent ball clamping arrangement, the back rest carrier being provided with successively arranged indentations or openings for a detent ball held in the indentations or openings by means of a clamping bevel engagable with the detent ball and a spring normally urging the clamping bevel into engagement with said detent ball, and the clamping bevel being disengaged from the spring loading by a push-button laterally extending from the housing, the housing carrying spring-loaded back rest carrier lateral play prevention means engaged with the back rest carrier for preventing lateral play movement of the back rest carrier in the housing.

2. A back rest in accordance with claim 1, in which the lateral play prevention means comprises two wedges each having an inner bevel face, the inner bevel faces of the wedges being engagable with each other, outside faces of the two wedges being parallel with each other, the outside face of one wedge adjoining a wall of the housing, the outside face of a other of the wedges adjoining a side of the back rest carrier, and the said one wedge being spring loaded at a wider end thereof with a spring carried in said housing and engaged with said one wedge wider end, said spring acting to push said one wedge to move its bevel face against the bevel face of said other wedge whereby a lateral force can be conducted from said other wedge to the back rest carrier.

3. A back rest in accordance with claim 2, in which the housing includes a base plate in which an opposite side of the back rest carrier is guided; the spring being supported in said base plate.

4. A back rest in accordance with claim 3, in which the base plate is provided with guidance means for guidingly receiving guidance components carried on the said other wedge, therewith to guide a movement of said other wedge.

5. A back rest in accordance with claim 3, in which the detent arm is pivotably mounted in the base plate.

6. A back rest in accordance with claim 1, in which in addition to the row of indentations or openings, in the back rest carrier, a further indentation or opening is carried therein, a spring-loaded locking means being carried in the base plate for engaging in said further indentation or opening to maintain the back rest at a selected height adjustment.

7. A back rest in accordance with claim 6, in which the locking means is a detent arm which engages in said further indentation or opening when the back rest carrier is pulled in one direction and releases therefrom when the back rest carrier is pushed in an opposite direction.

8. A back rest in accordance with claim 7, in which the detent arm is pivotably mounted in the base plate.

* * * * *